US008276426B2

(12) United States Patent
Musat et al.

(10) Patent No.: US 8,276,426 B2
(45) Date of Patent: Oct. 2, 2012

(54) LAMINATED MAGNETIC CORES

(75) Inventors: Rodica Musat, Haddonfield, NJ (US); Frank A. Raneiro, Pitman, NJ (US); Thomas H. Rooney, Jr., Oaklyn, NJ (US)

(73) Assignee: Magnetic Metals Corporation, Camden, NJ (US)

( * ) Notice: Subject to any disclaimer, the term of this patent is extended or adjusted under 35 U.S.C. 154(b) by 689 days.

(21) Appl. No.: 12/052,168

(22) Filed: Mar. 20, 2008

(65) Prior Publication Data

US 2008/0229799 A1 Sep. 25, 2008

Related U.S. Application Data

(60) Provisional application No. 60/896,191, filed on Mar. 21, 2007.

(51) Int. Cl.
*B21D 28/00* (2006.01)

(52) U.S. Cl. ..... 72/336; 72/333; 72/363; 72/443; 29/609

(58) Field of Classification Search ..... 72/46, 333, 72/336, 363, 405.04, 424, 428, 443, 20.1, 72/20.2, 31.11, 700; 29/596, 598, 609; 310/43; 414/788.9, 791.6, 793.5; 324/545; 148/120; 335/216, 299

See application file for complete search history.

(56) References Cited

U.S. PATENT DOCUMENTS

| | | | | |
|---|---|---|---|---|
| 3,299,304 | A * | 1/1967 | Hull | 310/216.127 |
| 3,946,884 | A * | 3/1976 | Kato et al. | 414/800 |
| 4,116,122 | A * | 9/1978 | Linder et al. | 100/48 |
| 4,150,411 | A | 4/1979 | Howell | |
| 4,208,895 | A * | 6/1980 | Grigorenko et al. | 72/17.2 |
| 4,777,446 | A * | 10/1988 | Santandrea et al. | 324/545 |
| 4,881,989 | A | 11/1989 | Yoshizawa et al. | |
| 4,917,358 | A * | 4/1990 | Ludkovsky | 266/104 |
| 4,922,604 | A * | 5/1990 | Marshall et al. | 29/598 |
| 5,113,736 | A | 5/1992 | Meyerle | |
| 5,245,904 | A | 9/1993 | Meyerle | |
| 5,550,327 | A * | 8/1996 | Neuenschwander | 177/25.14 |
| 5,915,750 | A * | 6/1999 | Usher et al. | 29/596 |
| 6,311,597 | B1 | 11/2001 | Schroth et al. | |
| 6,370,931 | B2 * | 4/2002 | Bennett | 72/336 |
| 6,463,781 | B2 * | 10/2002 | Watanabe et al. | 72/424 |
| 6,552,639 | B2 * | 4/2003 | Decristofaro et al. | 335/216 |
| 6,745,458 | B2 * | 6/2004 | Neuenschwander | 29/609 |
| 6,873,239 | B2 * | 3/2005 | Decristofaro et al. | 336/178 |
| 6,941,790 | B2 | 9/2005 | Rooney, Jr. et al. | |
| 7,011,718 | B2 * | 3/2006 | Decristofaro et al. | 148/121 |
| 7,067,944 | B2 * | 6/2006 | Lieu et al. | 310/43 |
| 7,114,365 | B2 | 10/2006 | Rooney, Jr. et al. | |
| 7,343,770 | B2 * | 3/2008 | Barnoski et al. | 72/456 |
| 7,382,138 | B1 * | 6/2008 | Umans | 324/545 |

FOREIGN PATENT DOCUMENTS

JP 2006-007232 * 1/2006

* cited by examiner

*Primary Examiner* — Edward Tolan
(74) *Attorney, Agent, or Firm* — Duane Morris LLP

(57) ABSTRACT

Laminations to be stacked as magnetic cores are produced from a very thin amorphous metal strip, using a punch press with accurate punch/die clearance. The laminations are collected on conveyor spindles or a transport rod or pipe, in either case being arranged without the need for substantial handling. Heat annealing and anti-vibration treatments can be applied along a conveying path. The laminations are grouped in a stack to define a core and are packaged or encapsulated in electrically nonconductive coverings. The finished core has advantageous electrical characteristics and low cost.

20 Claims, 7 Drawing Sheets

LAMINATED MAGNETIC CORES

CROSS REFERENCE TO RELATED APPLICATION

This application claims the priority of U.S. Provisional Patent Application Ser. No. 60/896,191, filed Mar. 21, 2007.

BACKGROUND OF THE INVENTION

1. Field of the Invention

The invention relates to a magnetic core having a stack of laminations, in particular wherein the laminations comprise an amorphous metal material. The method for making the laminations and the core containing them, includes stamping the laminations from an amorphous metal sheet using a closely guided high power stamping process, certain heat treatments, and techniques for automated handling using spindles are provided for processing the material into laminated magnetic cores.

2. Prior Art

As shown in FIGS. 1(*a*) to 1(*c*), a magnetic core 110 can comprises a stack of laminations 112, cut from strip of ferrous sheet metal 114. The laminations are shaped as required for the application, such as a transformer or inductor. In the example shown in FIGS. 1(*a*) to 1(*c*), the core 110 comprises a torus of annular rings, stacked axially.

Each lamination may be stamped from the sheet metal strip 114 in a blanking process. The strip 114 may comprise an electrical steel. Typically the laminations are at least between about 0.006 inch (152.4 μm) and 0.014 inch (355.6 μm) in thickness. Above that thickness, eddy current losses degrade the permeability of a magnetic core 110 containing the stack of laminations. Performance can also be adversely affected by plastic deformation and strains, especially at the inner and outer edges 112*a* and 112*b*, respectively, caused by the process of stamping the lamination, which can distort the edge crystal structure during stamping. These strains significantly degrade the magnetic properties of a magnetic core formed from such laminations.

The strip 114 may comprise Ni—Fe, and can vary as to specific composition and metallic structure. Different compositions and structures are characterized by differences in electromagnetic performance. Different compositions are relatively easier or more difficult to stamp in a manner that produces high quality laminations. Annealing after punching can relieve stresses and heal some of the edge deformation, but not eliminate them. It would be preferable if the stamping process could be arranged to avoid stress and deformation, or alternatively, arranged to enable stamping of more demanding material compositions that might improve the electrical performance of the resulting magnetic core.

SUMMARY OF THE INVENTION

One object of the present invention is to provide an apparatus and a process for punching thin laminations with minimized deformation, especially at the inner and outer edges of the laminations. Another object is to provide apparatus and a process for assembling a stamped thin laminations. A further object is to arrange the apparatus and associated methods to process and assemble laminations from amorphous metal sheet having a soft nanocrystalline magnetic character.

In one aspect, the method for forming ring laminations comprises stamping the ring laminations from an amorphous metal sheet in a punch press. The amorphous metal sheet may be annealed prior to stamping to form a nanocrystalline soft magnetic material. The punch press can have a cylindrical guide characterized by accurate relative positioning of the punch and die structures in a direction lateral to the press direction. The press is advanced at approximately 7 to 12 feet per second at the point of contact. According to another aspect ring shaped laminations produced in the manner described are collected on a spindle associated with a conveyor apparatus. A predetermined number of stamped ring laminations, queued on the spindle, are picked off and packaged in an electrically nonconductive container, which is capped or closed to provide the magnetic core comprising the stack of laminations.

The stamped ring laminations optionally can be heat treated or annealed after being stamped. A vibration dampening agent optionally can be applied to the ring laminations on the spindle during the process, preferably before removing the ring laminations from the spindle. An electrical test can optionally be conducted on the magnetic core to select or reject magnetic cores according to desired electrical specifications.

Amorphous metal is brittle and is produced in very thin coil strips, typically 0.0007 to 0.0010 inches thickness. In a punch and die arrangement for a blanking press, the clearance or lateral space between the edges of a punch and die between which material is sheared, might be 10% of the material thickness. To stamp material that is 0.0007 inch thick material with a clearance that is 10% of the thickness (0.00007 inch) is quite demanding. Attempts to stamp amorphous metal material have produced fractures along the edges of the lamination, making them unsuitable for electrical reasons. If thin amorphous metal laminations are produced, they are very fragile and must be handled in a manner that protects the laminations at least up to the point that they are stacked. The present invention provides both the punch press structure and the material and material handling arrangements that make an amorphous metal laminated core possible and practical.

Other aspects and further embodiments of the invention will be apparent from the following description.

BRIEF DESCRIPTION OF THE DRAWINGS

There is shown in the drawings exemplary forms of the invention as presently preferred; however, the invention is not limited to the specific arrangements and instrumentalities disclosed in the following appended drawings, wherein:

FIG. 2(*b*) illustrates a ring lamination produced from the punch and die combination of FIG. 2(*a*).

DETAILED DESCRIPTION

According to the invention, a laminated magnetic core is formed from a stack of ring laminations by blanking an amorphous metal sheet, strip or ribbon in a high velocity punch press. The laminations as thus formed are processed and assembled to provide magnetic cores.

One suitable method for forming the amorphous metal strip is by melt spinning on a super cooled fast spinning wheel. One type of such amorphous metal strip is known as METGLAS® and is available from Metglas, Inc. Conway, S.C. The amorphous metal strip may be annealed prior to stamping to form a nanocrystalline soft magnetic ribbon. A suitable example of a nanocrystalline soft magnetic strip is described in U.S. Pat. No. 4,881,989 (the disclosure of which is incorporated by reference herein), and is available as FINEMET® from Hitachi Metals, Ltd., Tokyo, JAPAN. Preferably the amorphous metal strip used in the present invention has a thickness between approximately 0.0007 inch (17.78 μm) and 0.0010 inch (25.4 μm).

Figure 1A:
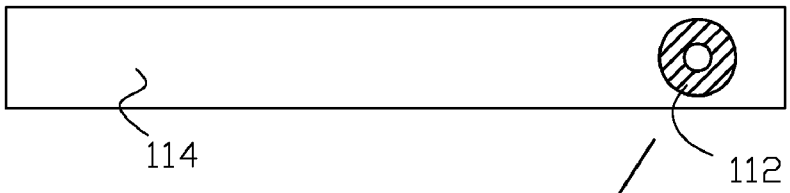
FIG. 1(*a*) illustrates a strip of work material from which a ring lamination, shown in FIG. 1(*b*) can be stamped to form a ring magnetic core, shown in cross section in FIG. 1(*c*) from a stack of laminations.
Figure 1B:
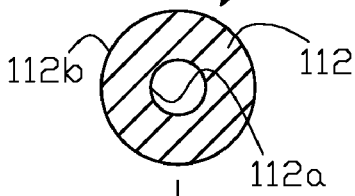
Figure 1C:
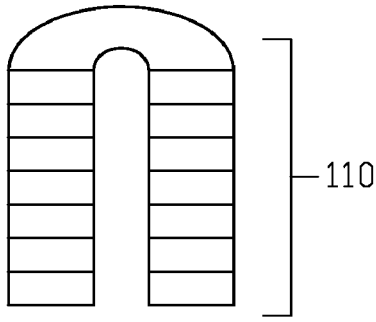

A suitable punch press for stamping the laminations is described in U.S. Pat. No. 5,113,736 and U.S. Pat. No. 5,245,904 (also hereby incorporated by reference), which punch press is generally referred to herein as an electromagnetic punch press. Referring to the element numbers in these patents, female die (32), and male die (34) (see FIG. 1 in both the '736 and '904 patents), correspond to die 32 and punch 34, respectively, in attached FIG. 2(*a*), which represent one non limiting example of a punch and die combination that can be used in the electromagnetic punch press to stamp, for example, ring lamination 36 in attached FIG. 2(*b*) from amorphous metal strip 38. The punch and die combination, shown generally as telescopically engaged cylindrical elements, can be arranged as in U.S. Pat. No. 6,311,597 and/or can be mounted for movement on relatively movable press elements as is U.S. Pat. Nos. 6,941,790 or 7,114,365. The disclosures of these patents are likewise incorporated herein, in their entireties.

Work material "W", which in the present invention can be an amorphous metal strip or a nanocrystalline soft metal strip, is suitably fed into the die set (30) of the two referenced patents. Independent self-centering pilots can be included to locate the strip accurately in the die prior to stamping.

By stamping the laminations from the amorphous metal strip using accurately dimensioned punch and die element that are accurately guided, the amorphous metal strip material can be sheared with minimal fracturing along the inner and outer edges of each ring lamination. This is achieved in part by use of a stamping tooling with punch die clearance of about 10% of the material thickness, per side, and utilizing a die set comprising a large reciprocating bearing as described in U.S. Pat. No. 6,311,597. This structure allows mounting of punch components inside the inner race and mounting the die components to the outer race.

Operating the punch press at relatively high operational velocities, for example 7 to 12 feet per second, with a stamping apparatus arranged with a reciprocating bearing for guidance and the 10% clearance mentioned, it has been found that an amorphous strip with a thickness between about 17.78 μm and 25.4 μm can be produced with advantageous characteristics. The outer and inner diameters of the amorphous laminates may be varied to obtain the desired electrical and magnetic characteristics. In one embodiment, the maximum outer radius of a ring core is approximately 1.675" and the minimum inner diameter of a ring core is approximately 0.010".

Figure 2A:
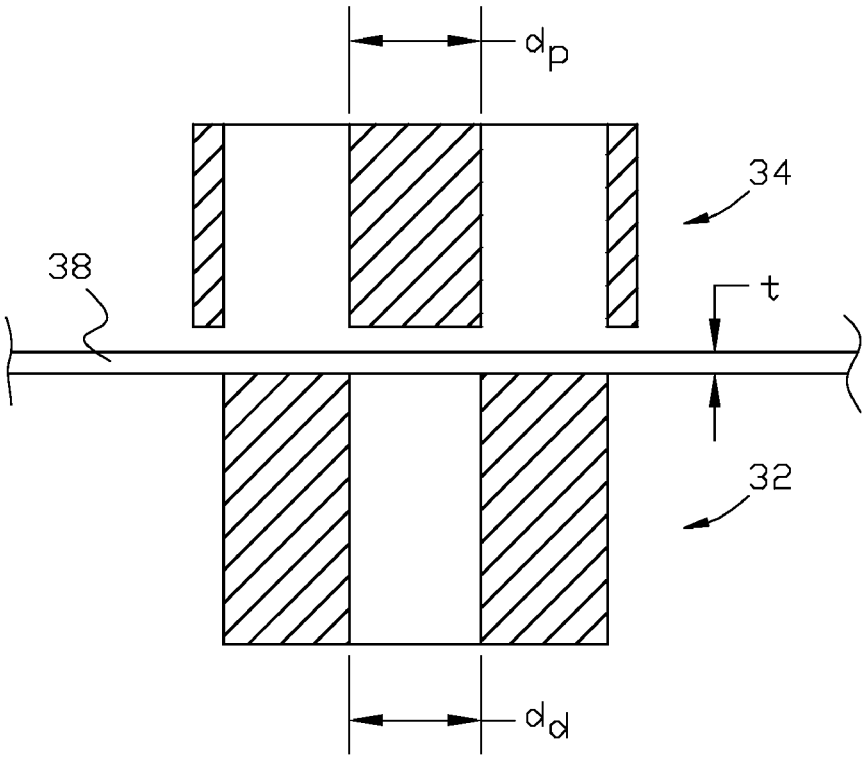
FIG. 2(*a*) schematically illustrates a punch and die combination with a cylindrical guidance arrangement that can be used is a punch press for producing ring laminations for a laminated magnetic core according to the invention.
Figure 2B:
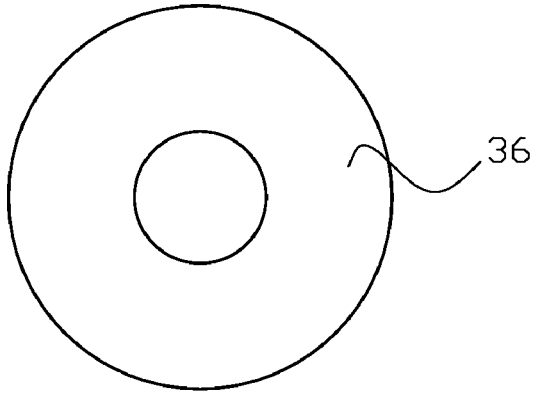

The punch-die clearance, which is relatively tight as thus specified, is defined as a relative clearance, per side, in percent of the material thickness, and is represented by the equation:

$$c = \frac{d_d - d_p}{2t} \cdot 100 \text{ percent},$$

where c equals radial clearance in percent;

$d_d$ equals the diameter of the die (refer to FIG. 2(*a*));

$d_p$ equals the diameter of the punch (refer to FIG. 2(*a*)); and t equals the thickness of the material (refer to FIG. 2(*a*).

Figure 3:
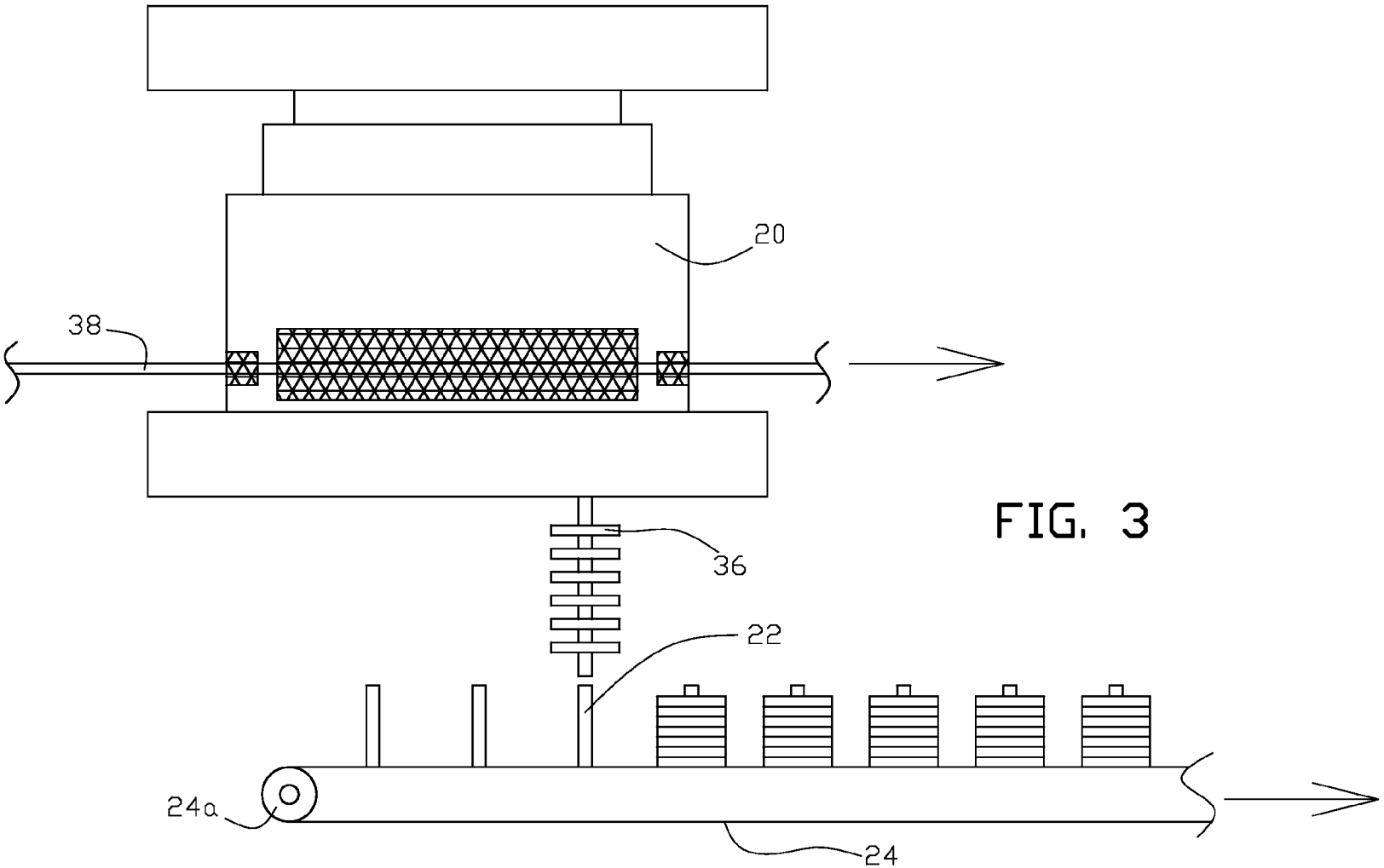
FIG. 3 is a schematic illustration of a method for collecting and conveying stamped laminations from the punch press into stacks to be associated as magnetic cores.

As shown in FIG. 3, stamped laminations 36 ejected from punch press 20 can be guided (e.g., dropped by gravity) onto a pin or spindle 22 carried on a conveyor 24 that collects and advances a predetermined number of laminations in stacks along a processing direction. The conveyor can be driven by a suitable indexing drive comprising electrically driven roller 24*a*. After a number of laminations are deposited on a given spindle, the conveyor advances to the next spindle, repetitively collecting and stacking the laminations.

Figure 4:
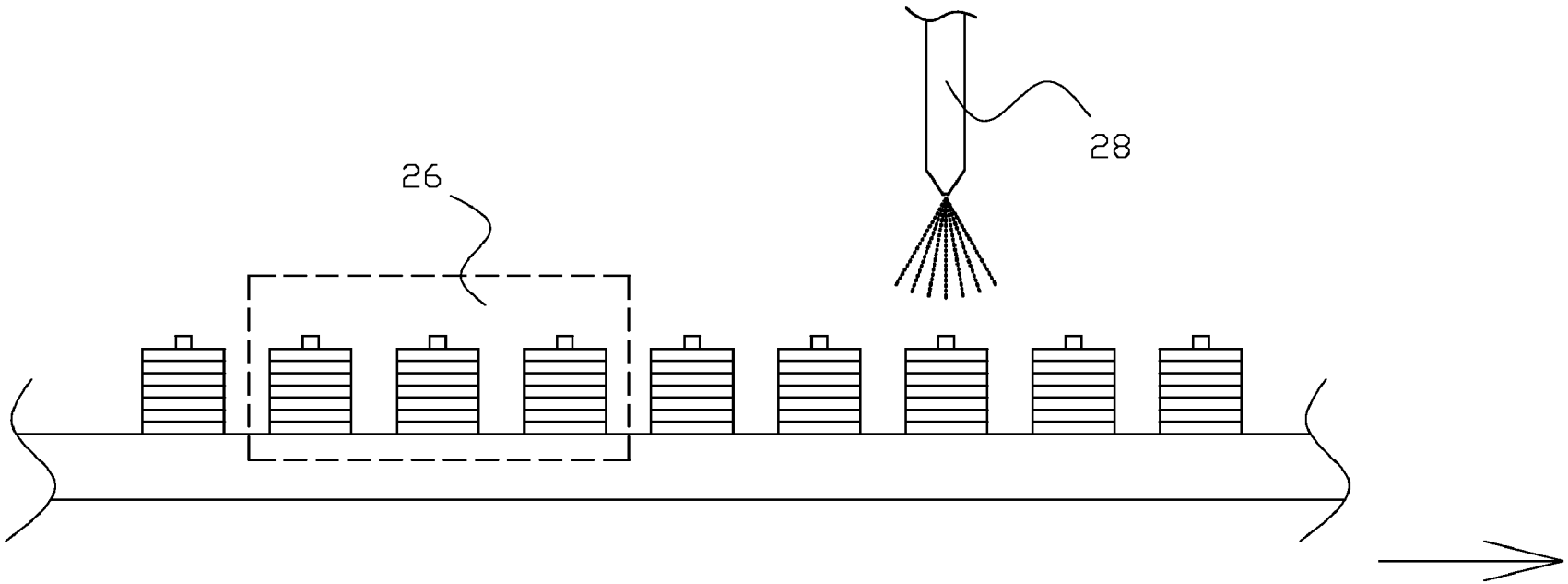
FIG. 4 illustrates further steps including treatment of the stacked laminations.

Heat treatment optionally can be applied after stamping the laminations to anneal the amorphous metal material. In that case, the laminations 36 can be heat treated before stacking on the spindles. Alternatively and as shown in FIG. 4, the laminations can be carried by the conveyor, after stacking, directly to a heating apparatus. For example a tunnel oven 26 can be provided along the conveying path, as shown in FIG. 4. The oven can define a space heated, for example, by electric resistance or fossil fuel. Alternatively, electric induction heating may be used not only to heat treat the stacked lamination, but also to alter the magnetic properties of the laminations. In one embodiment, the laminations are heat treated to a temperature between about 700 degrees Fahrenheit to about 1080 degrees Fahrenheit for approximately 20 minutes to 120 minutes in a nitrogen atmosphere. The nitrogen is replenished at 400 standard cubic feet per hour (SCFH). Note that the heat treatment time, temperature, and atmosphere may be varied to achieve the desired crystalline structure, and thus the desired electrical and magnetic properties of the laminates.

After such heat treatment (or after punching, if heat treatment is not required), a vibration dampening agent, such as light oil, optionally can be applied to the laminations, for example, using a spray apparatus 28 as shown in FIG. 4. This treatment is useful to dampen electromechanical vibration of the laminations when ac current is applied to an assembled magnetic core.

In a final step, a stack containing the required number of laminations is mounted in an electrically non-conductive container as a finished core. The number of laminations in a stack may be varied and depends upon the desired electrical and magnetic properties of a finished magnetic core. The laminations can be transferred from a spindle as in FIG. 4 and placed in a nonconductive container such as a plastic case, which is potted or capped to seal the container. Other encapsulation materials, such as, for example, glass filled nylon, aluminum epoxy, and polyurethane may be used to encase the laminates. Alternatively the stack of laminations, on a conveyor spindle, or after transfer to a different holder, can be transferred to suitable encapsulation apparatus for encapsulation in a nonconductive coating or encapsulating material. In one embodiment, the nonconductive container is sized such that the stacked laminates may move within the container.

The magnetic cores can be subjected to an electrical test process along the process for automated selection and rejection of cores according to a desired specification. Preferably, testing and selection are accomplished after the cores are packaged in containers or encapsulated so as to represent the finished product. The cores can be coupled between a coil applying an exciting signal and a coil coupled to suitable test equipment (not shown) to assess whether the response to the excitation is within predetermined tolerances.

Figure 5:
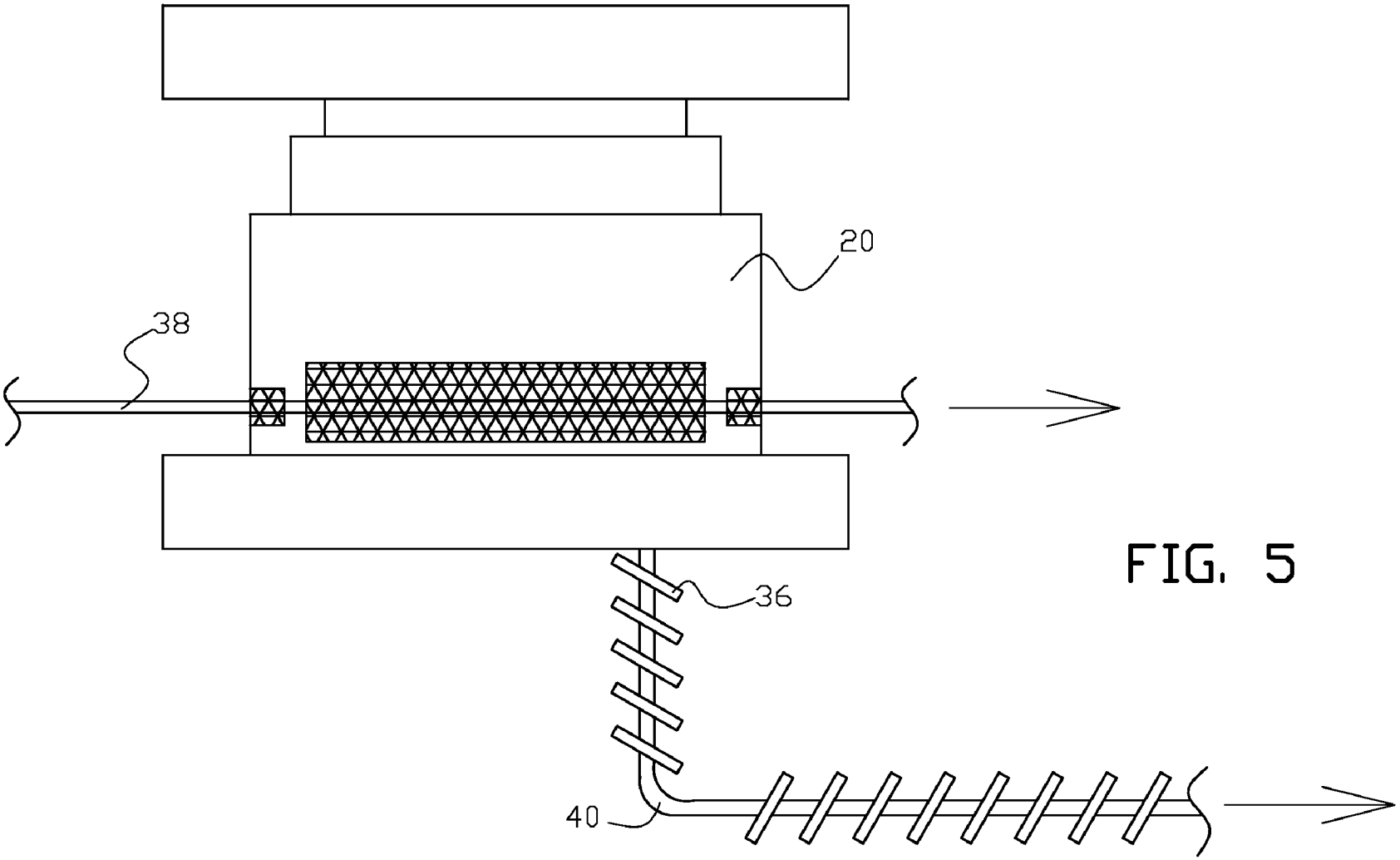
FIG. 5 is a schematic illustration of an alternative processing embodiment wherein the laminations are collected from the punch press accumulated on a spindle.
Figure 6:
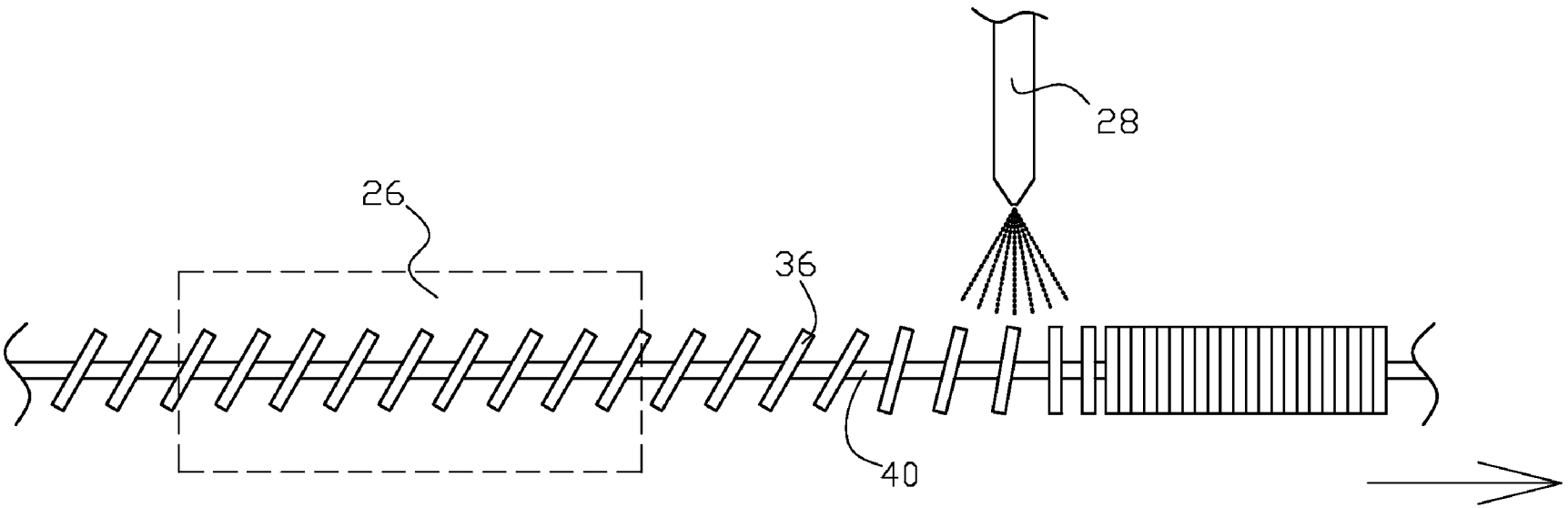
FIG. 6 shows further treatment of the laminations accumulated on the spindle.
Figure 7:
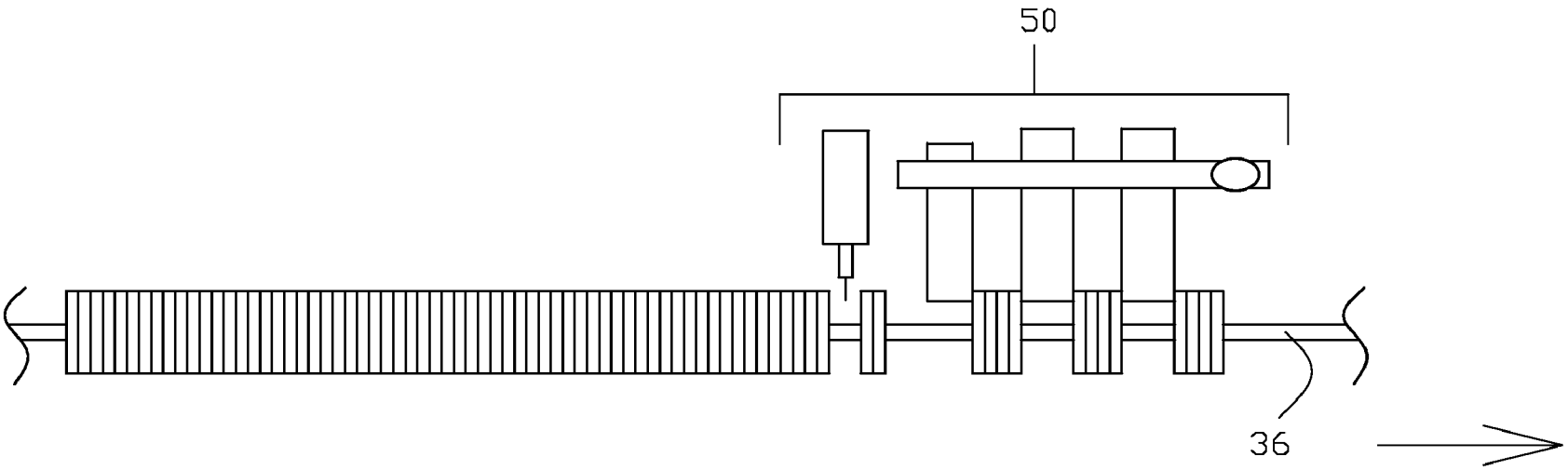
FIG. 7 illustrates picking a predetermined number of laminations from the spindle for association as a magnetic core in conjunction with packaging and optional testing steps.

As an alternate configuration of the production arrangements is shown in FIGS. 5-7. In this example, the laminations 36 separated from the metal strip 38 by the punch press 20 are guided along a transport wire or tube 40, which can be inclined along at least part of its path to feed the laminations from the punch press to the further processing stations. A properly positioned and controlled source of pressurized air also can be used to advance the laminations along the transport tube.

If heat treatment is required after stamping of the laminations, the laminations on the transport tube can be moved through a heating apparatus 26 as shown in FIG. 6. The oven may define a heated space or may apply electromagnetic induction heating to the laminations for purposes of annealing and/or adjusting the electromagnetic properties of the material.

After heat treatment (or after stamping if heat treatment is not required), a vibration dampening agent, such as light oil, optionally can be applied, for example, by spray apparatus 28. In this embodiment, the laminations are fed by the spray apparatus on the feed tube or wire 40. The laminations accumulated in a queue on feed tube or wire 40 for packaging or encapsulation.

As shown in FIG. 7, the laminations are sorted by a mechanism 50. Mechanism 50 may include a blade having an edge that is advanced between adjacent laminates to separate a predetermined number or stack height of laminates into a group prior to being encapsulated. The predetermined number or stack height of laminations have a given thickness and physical characteristics that are advantageous for forming magnetic cores. As described above, the encasement or encapsulation is preferably a nonconductive case or coating that confines and electrically insulates the core. A feedback loop may be provided from test equipment to the mechanism 50. The assembled cores may be tested at test equipment and the results fed back to mechanism 50. If an assembled core does not have the desired electrical or magnetic characteristics, mechanism 50 may be configured to automatically adjust the number of laminations in a group so the assembled cores have the desired characteristics. Additionally, an accept/rejection step, or alternatively a step of sorting the finished cores, can be used to discriminate according to the electrical characteristics of the finished cores. For example, the finished magnetic cores may be sorted according to their impedance permeability within a predetermined range, and any finished magnetic core having an impedance permeability falling outside of the range may be rejected.

In the foregoing examples, the laminations and assembled cores are handled by spindles and guide rods. It is also possible to provide other handling arrangements. For example, the laminations ejected from the punch press can be collected loosely in a container that is passed through a heater or into which a vibration damping agent is injected. The laminations can be assembled into cores by nesting arrangements that position the laminations in stacks or move the laminations by gas (air) pressure. Springs and solenoids are possible but may risk damage to the fragile laminations.

The use of thin amorphous metal as described herein achieves a substantial cost saving in the lamination material, compared to alternative materials. According to the invention, a cylindrically guided or similarly precise punch press can produce the laminations without undue incidence of fracturing along stamped edges. The invention is readily automated as described thereby reducing labor requirements, and by minimizing or eliminating handling, further protects the fragile laminations from damage.

The foregoing disclosure describes a number of embodiments and alternatives, but these are intended as examples. The invention is not limited to the arrangements disclosed as examples demonstrating the subject matter, and is capable of embodiment in other ways consistent with this disclosure.

What is claimed is:

1. A method for forming a magnetic core comprising the steps of:

stamping an amorphous metal strip with a high-velocity punch and die to create one or more laminates, wherein the stamping includes advancing the high velocity punch and die at a speed between seven feet per second and twelve feet per second at a point of contact with the amorphous metal strip, for separating a laminate from the strip, the punch and die having a clearance based in part on a thickness of the amorphous metal strip;

grouping a pre-determined number of laminates in a stack; and encapsulating the pre-determined number of stacked laminates in an electrically nonconductive container, the encased laminates forming a magnetic core.

2. The method of claim 1, further comprising the steps of:

collecting the one or more laminates on a cylindrical transport rod; and advancing the one or more laminates along the cylindrical transport rod from the high-velocity punch and die to an encapsulation apparatus.

3. The method of claim 2, wherein during the advancing step the one or more laminates are heat treated to a temperature between about 700 degrees Fahrenheit to about 1080 degrees Fahrenheit.

4. The method of claim 2, wherein during the advancing step a vibration dampening agent is applied to the one or more laminates.

5. The method of claim 1, further comprising the steps of:

testing an electrical characteristic of the magnetic core; and adjusting the number laminates in a stack based on a result of the testing.

6. The method of claim 1, further comprising the step of:

rejecting a magnetic core if a test result identifies the magnetic core as not having an electrical characteristic within a desired range.

7. The method of claim 1, further comprising the step of:

sorting one or more magnetic cores into groups according to an electrical characteristic of the magnetic cores.

8. The method of claim 1, wherein the punch and die clearance is approximately ten percent of the thickness of the amorphous metal strip.

9. The method of claim 1, further comprising the step of:

advancing the one or more laminates on a conveyor from the high velocity punch and die to an encapsulation apparatus.

10. The method of claim 3, wherein the laminates are heat treated in a nitrogen atmosphere.

11. The method of claim 3, wherein the laminates are heat treated for approximately twenty minutes to about 120 minutes.

12. A system comprising:

a punch press including a punch and die configured to stamp an amorphous metal sheet into one or more laminates, the punch and die having a clearance based in part on a thickness of the amorphous metal sheet, wherein the punch press is configured to advance the punch toward the die at a speed between seven feet per second and twelve feet per second at a point of contact with the amorphous metal sheet; and an encapsulation apparatus configured to group the one or more laminates into a pre-determined number of laminates, the encapsulation apparatus further configured to encapsulate the pre-determined number of laminates in an electrically non-conductive container.

13. The system of claim 12, further comprising:

a conveyor disposed between the punch press and the encapsulation apparatus, the conveyor configured to receive the one or more laminates from the punch press and transport them in a processing direction towards the encapsulation apparatus.

14. The system of claim 12, wherein the clearance between the punch and the die is approximately ten percent of the thickness of the amorphous metal sheet.

15. The system of claim 13, further comprising:

an oven disposed along a length of the conveyor, the oven configured to heat treat the one or more laminates at a temperature between 700 degrees Fahrenheit and about 1080 degrees Fahrenheit.

16. The system of claim 15, wherein the one or more laminates are heat treated for about twenty minutes to about 120 minutes.

17. The system of claim 13, further comprising:

a spray apparatus disposed along a length of the conveyor, the spray apparatus configured to apply a vibration dampening agent to a surface of the one or more laminates.

18. The system of claim 12, further comprising:

a testing apparatus connected to the encapsulation apparatus, the testing apparatus configured to test a physical property of the encapsulated one or more laminates, the testing apparatus further configured to transmit a signal to the encapsulation apparatus such that the encapsulation apparatus adjusts the number of laminates in a group based on a result of the test.

19. A method for forming magnetic laminations from an amorphous metal strip, comprising the steps of:

feeding a sheet of work material comprising an amorphous metal strip between a punch and a die;

advancing the punch and die against the sheet of work material using an electromagnetic punch press for stamping a lamination from the work material, wherein the stamping includes engaging the punch and die with the work material at a velocity between about seven feet per second and about twelve feet per second at a point of contact with the work material.

20. The method of claim 19, further comprising annealing the amorphous metal strip prior to stamping such that the sheet of work material comprises a nanocrystalline soft metal strip from which the lamination is stamped.

* * * * *